US005682962A

United States Patent [19]

Lo

[11] Patent Number: 5,682,962

[45] Date of Patent: Nov. 4, 1997

[54] PERSONAL PORTABLE LIFE-SAVING DEVICE

[76] Inventor: Show Yao Lo, No. 40, Sec. 1, Chung shan Rd., Shin Junj City, Taipei Hsien, Taiwan

[21] Appl. No.: 697,348

[22] Filed: Aug. 22, 1996

[51] Int. Cl.[6] ..... A62B 1/08

[52] U.S. Cl. ..... 182/240; 182/235; 182/237; 182/72

[58] Field of Search ..... 182/70, 71, 72, 182/73, 236, 237, 240, 235

[56] References Cited

U.S. PATENT DOCUMENTS

| | | | |
|---|---|---|---|
| 297,126 | 4/1884 | Freeman | 182/235 |
| 484,042 | 10/1892 | Murphy | 182/72 X |
| 612,673 | 10/1898 | Reidy | 182/235 |
| 797,903 | 8/1905 | Meaders | 182/240 |
| 1,241,701 | 10/1917 | Bencur | 182/240 |
| 2,561,832 | 7/1951 | Wilson | 182/235 |
| 5,076,395 | 12/1991 | Kikuchi | 182/235 X |

*Primary Examiner*—Alvin C. Chin-Shue
*Attorney, Agent, or Firm*—Bacon & Thomas

[57] ABSTRACT

A personal portable life-saving device includes a housing, a reel set, at least a guide roller, a control disk, a braking unit, a metal strap and a body fastening means. In case a fire accident happens in a high building, the user may fasten the metal strap to any fixed object in the building, tie the body fastening means about his/her body and jump off the building by holding the housing. The user may adjust the dropping speed and land safely.

7 Claims, 6 Drawing Sheets

PERSONAL PORTABLE LIFE-SAVING DEVICE

BACKGROUND OF THE INVENTION

1. Field of the Invention

The present invention relates generally to a life-saving device, and more particularly to a personal portable life-saving device for helping the user to gradually drop to safe ground at an adjustable speed from a high building during fire accidents or the like.

2. Description of the Prior Art

With the increase in the global population, which is concentrated mainly in cities, more and more high-rise buildings are constructed. When fire accidents happen in high-rise buildings, it is difficult for people trapped in the upper floors to escape.

There is available a kind of life-saving device that may be mounted at the verandah or balcony of each apartment or floor. It mainly comprises a steel cable which may drop one person at a time to the ground. When there are many people trapped in the same apartment or floor, they may be burnt or suffocated to death before they can get a ride on that life-saving device. It is therefore imperative that a personal portable life-saving device be provided to help evacuate people from a fire site effectively, quickly and safely.

SUMMARY OF THE INVENTION

Accordingly, a primary object of the present invention is to provide a personal portable life-saving device which may be conveniently carried by a user or may be stored in a large number at apartments or offices for emergency use so that a large number of people may escape from a high building during fire accidents or the like.

Another object of the present invention is to provide a portable life-saving device in which the user may adjusting the dropping speed according to his/her weight.

In order to achieve the above-mentioned objects, the present invention essentially comprises a housing accommodating a reel set, a metal strap, a braking unit, and a body fastening means. The metal strap may be fastened to any fixed object in the building and the body fastening means may be tied about the user's body. The user may jump off the building by holding the housing at an adjustable speed.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
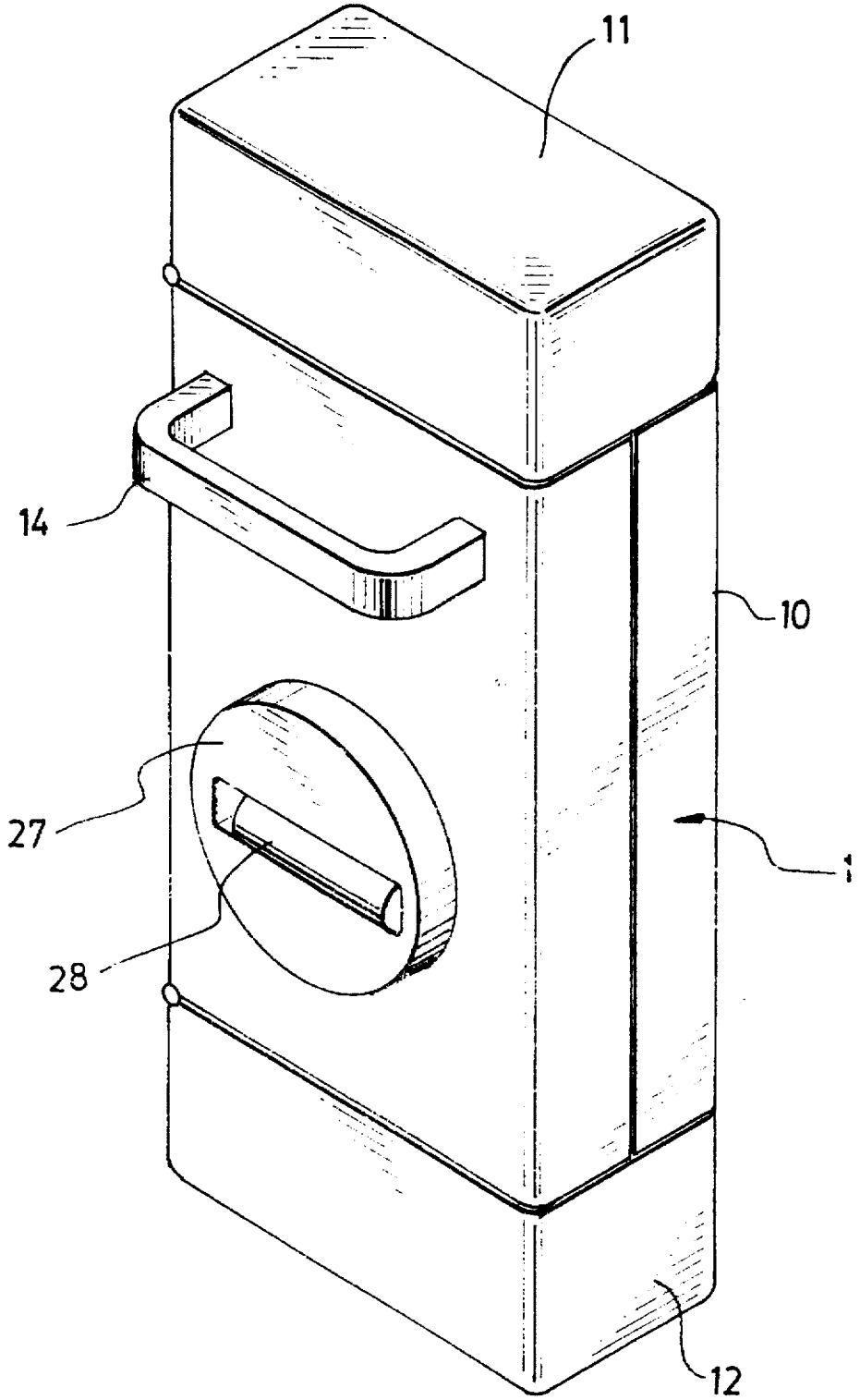
FIG. 1 is an elevational view of the life-saving device of the invention.

With reference to FIG. 1, the personal portable life-saving device according to the present invention essentially comprises a housing with a middle seat 10, an upper lower 11 and a lower cover 12 respectively at its ends. The middle seat 10 has a control disk 33 at one side and a handle 14 as well as a rewinding disk 27 at the other side.

Figure 2:
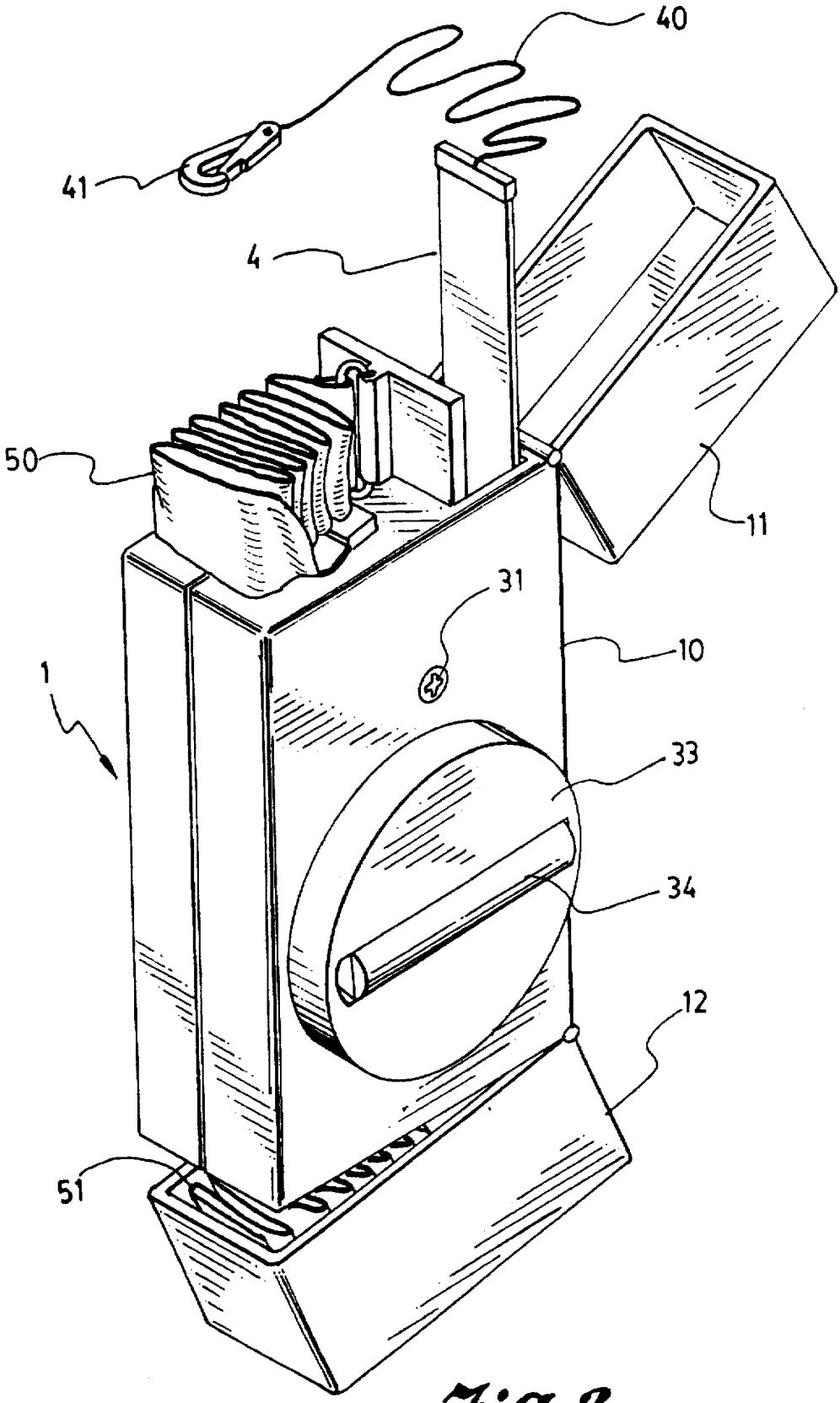
FIG. 2 is an elevational view of the life-saving device of the invention, showing an upper cover and a lower cover lifted.

With reference to FIG. 2, after the upper cover 11 is opened, a metal strap 4 may be pulled out. The metal strap 4 may be as long as tens of meters, with a rope 40 and a snap ring 41 at its end. A chest strap 50 may also be concealed within the upper cover 11. After the lower cover is opened, a hips strap 51 may be pulled out. The chest strap 50 and the hips strap 51 are provided as a body fastening means 5 for tying about the chest and the hips. The control disk 33 is provided with an extension rod 34 which may be extended for gripping by the user.

Figure 3:
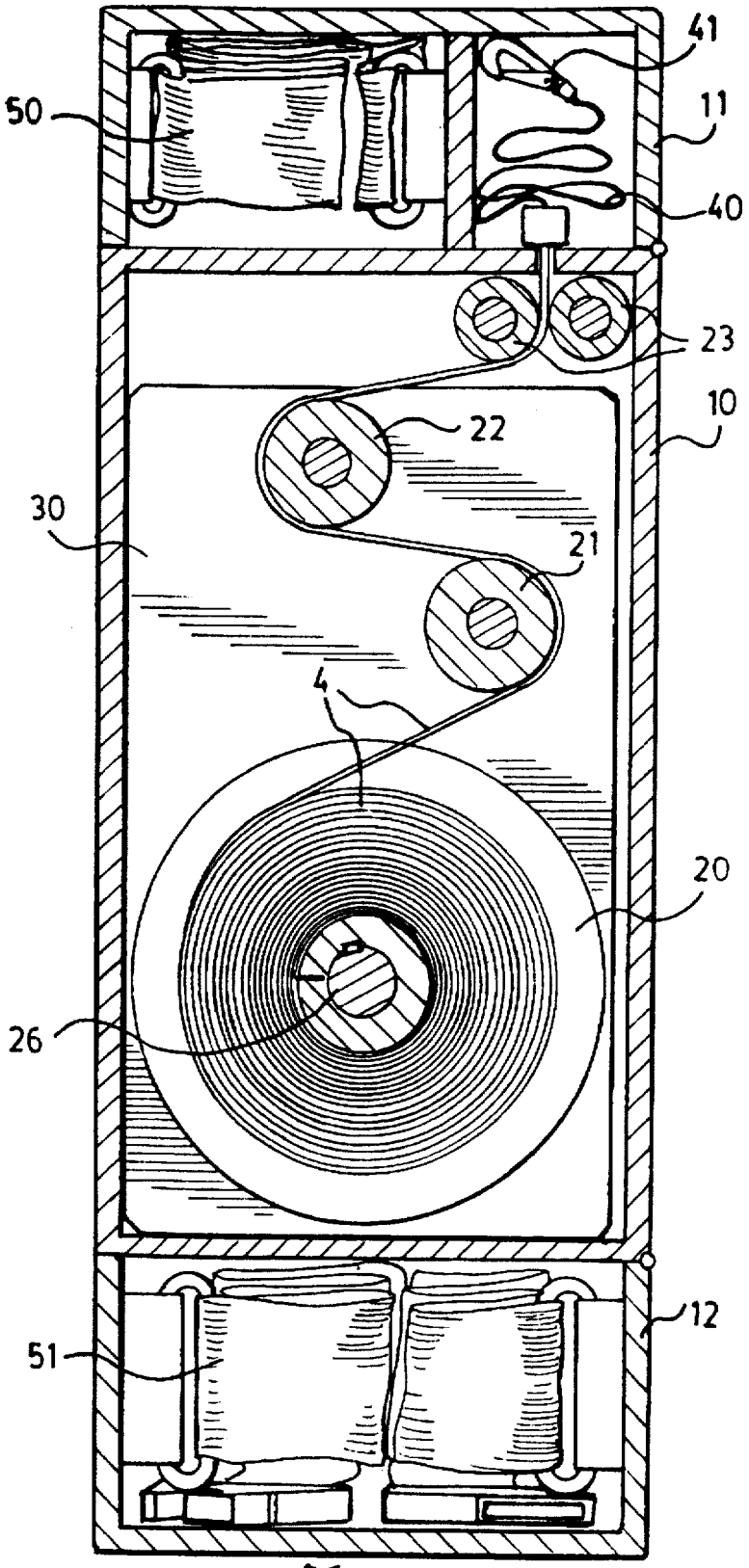
FIG. 3 is a sectional view of the life-saving device of the invention.

Referring to FIG. 3, the middle seat 10 accommodates a reel set 2 including a main reel 20 of a relatively large size and two auxiliary rollers 21, 22. The main reel 20 is provided with a deep-set groove 24 for receiving the metal strap 4 and is so designed as to be capable of containing the metal strap 4 which is tens of meters long. The metal strap 4 is wound on the main reel 20 and is passed round the two auxiliary rollers 21, 22 before it is pulled out via a guide roller 23 or between two guide rollers 23.

Figure 4:
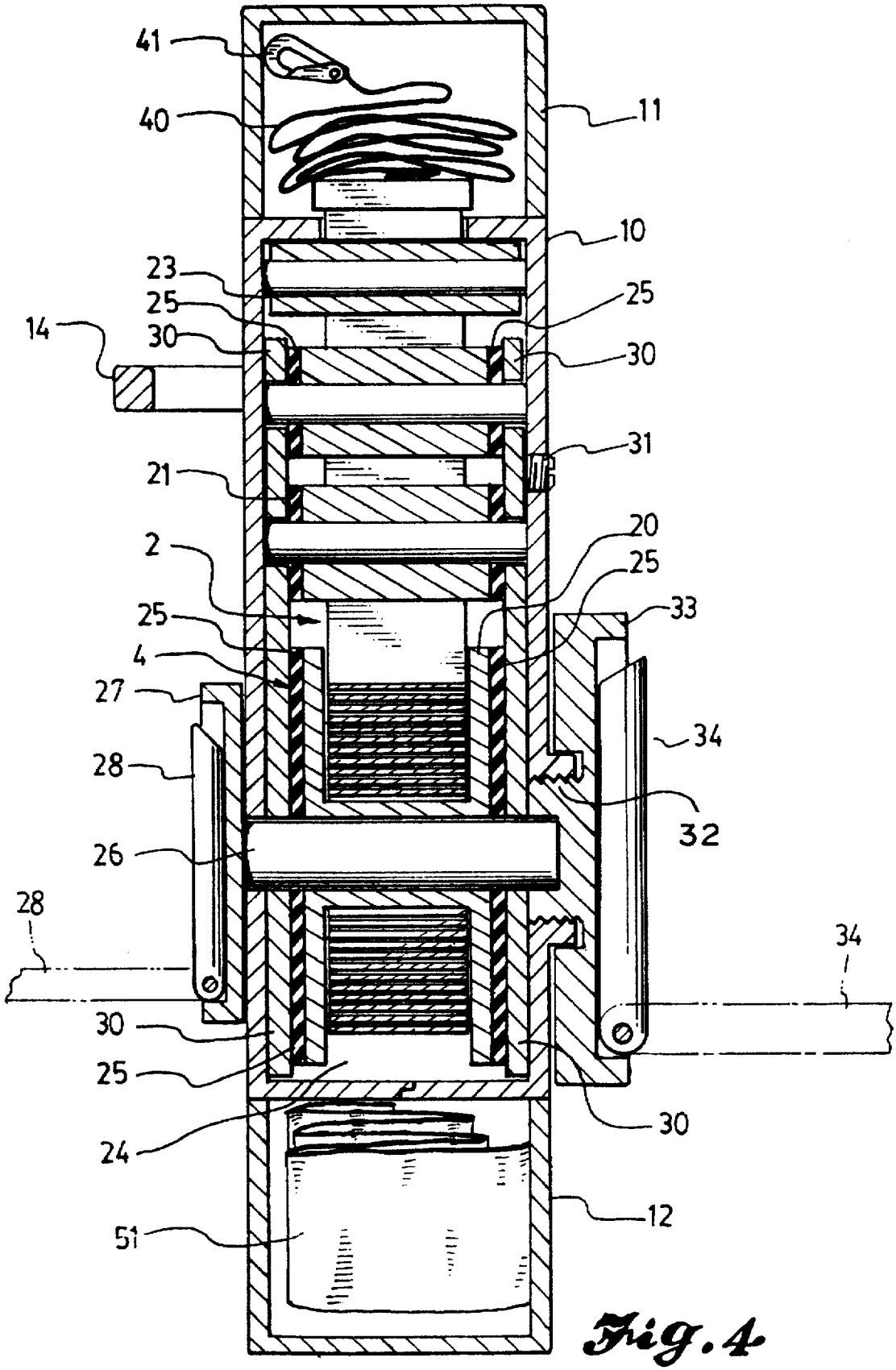
FIG. 4 is another sectional view of the life-saving device of the invention.

As shown in FIG. 4, the main reel 20 as well as the auxiliary rollers 21, 22 are all provided with a lining 25 for braking purposes at either axial end. A braking unit 3 includes two braking plates 30. The braking plates 30 are respectively disposed at the two sides of the main reel 30 and the auxiliary rollers 21, 22. The control disk 33 is located at the side of the braking plate 30 near the main reel 20. The control disk 33 has a screw rod 32 at its center for engaging a screw hole 13 on the middle seat 10 such that, when the control disk 33 is turned, the end of the screw rod 32 may press against or release the braking plate 30. In addition, a press screw 31 is arranged on the outside of the braking plate 30 to one side of the auxiliary rollers 21, 22. The press screw 31 may also be turned to press against or release the braking plate 30.

The extension rod 34 of the control disk 33, after being extended, may be used to turn the control disk 33. In other words, it may be used to adjust the braking extent of the braking unit 3.

The braking effect is achieved by utilizing the braking plates 30 at both sides of the main reel 20 and the auxiliary rollers 21, 22. It is generated as a result of the pressure between the braking plate 30 and the linings 25 at the axial ends of the main reel 20 and the auxiliary rollers 21, 22, the pressing force coming from the press screw 31 and the screw rod 32.

The press screw 31 imposes a considerable pressing force on the braking unit 3 so that the rotation of the main reel 20 and the auxiliary rollers 21, 22 may be subjected to the rubbing of the braking plates 30, thus generating resistance. The screw rod 32 of the control disk 30 is provided for the user to adjust the braking extent as determined by the user's weight and the surroundings.

Figure 5:
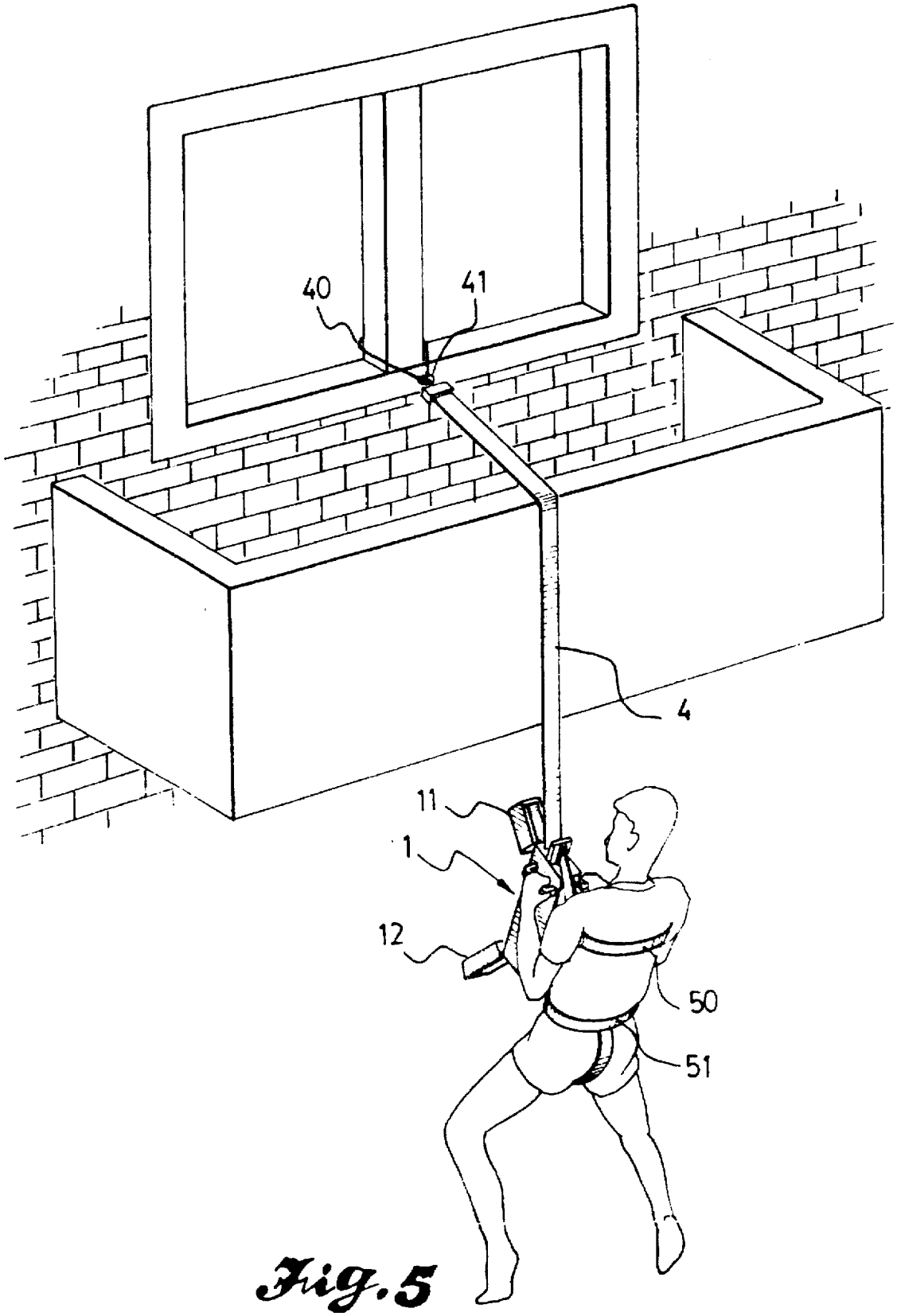
FIG. 5 is a schematic view illustrating a user using the life-saving device of the invention to drop from a building.
Figure 6:
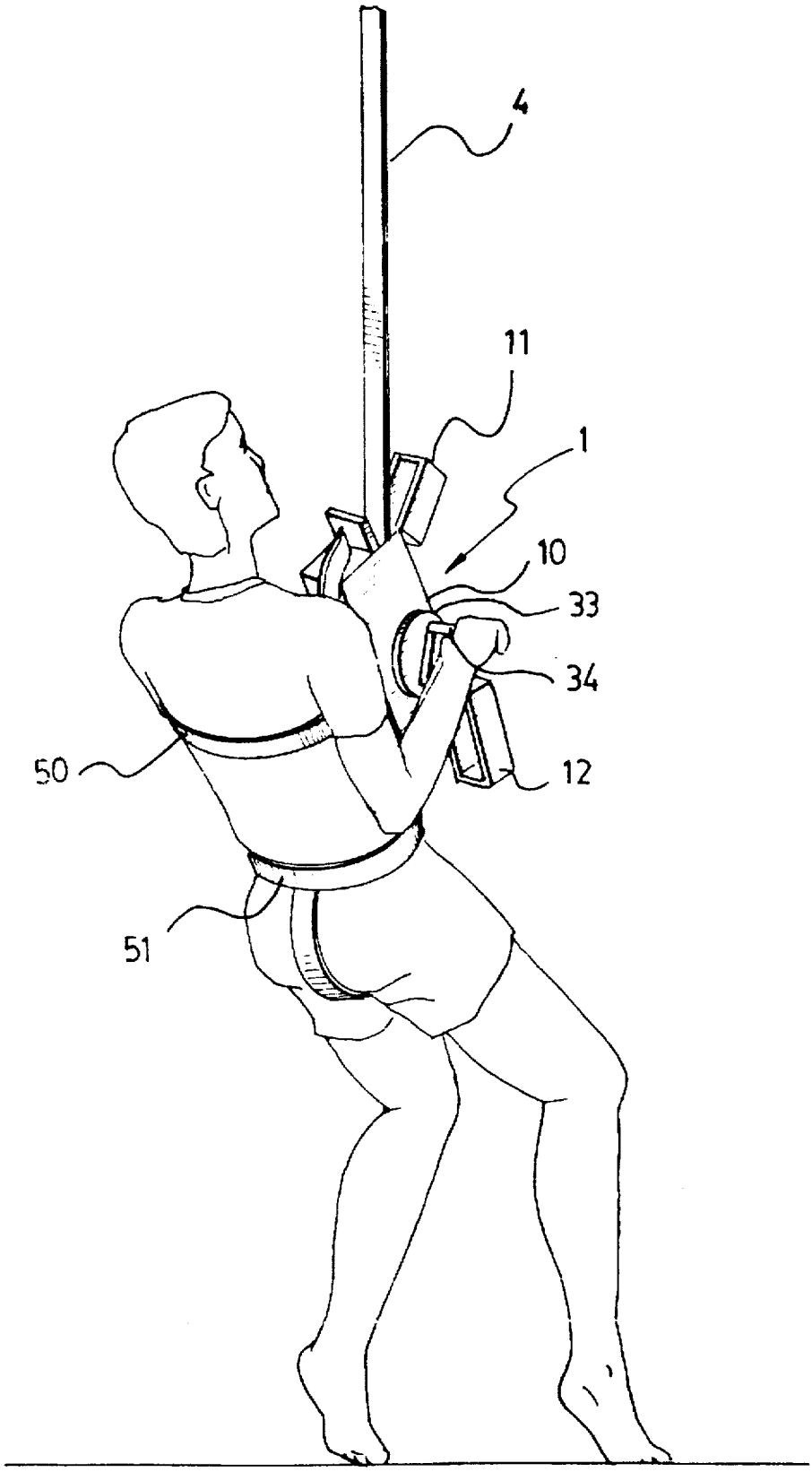
FIG. 6 is another schematic view illustrating the user's operation of the life-saving device of the invention.

As shown in FIGS. 4 and 5, when the user is trapped in a high building which is on fire, he/she may utilize the life-saving device of the present invention to escape to safe ground. Referring back to FIGS. 1 and 2, the user firstly has to open the upper cover 11, pull out the metal strap 4, and tie the rope 40 firmly onto any fixed object in the room by means of the snap ring 41. Then the body fastening means 5 has to be taken out. The user may then tie the chest strap 50 and the hips strap 51 about his/her chest and hips and jump off the window or verandah by holding the housing 1.

Reference is made to FIGS. 3 and 4. The user may drop to the ground gradually by means of the present invention. The length of the metal strap 4 wound on the main reel 20 is sufficient. And the speed the metal strap 4 is pulled out is determined by the pulling force and the rubbing forces of the main reel 20 and the auxiliary rollers 21, 22. The press screw 31 imposes a certain pressure on the braking plates 30. When the metal strap 4 is pulled out of the main reel 20, passing round the auxiliary rollers 21, 22, there is a certain resistance to be overcome, thus slowing down the dropping speed. When the user escapes from the building following the operation described above, he/she may drop to the ground at a safe and slow speed. Furthermore, the control disk 30 allows the user to adjust the dropping speed at any time during the drop. The user may extend the extension rod 34 to turn the control disk 33 so that the screw rod 32 may press against or release the braking plate 30 to increase or decrease the rubbing force borne by the main reel 20 and the auxiliary rollers 21, 22, arriving at a dropping speed most safe for the user according to his/her weight.

After landing at safe ground, the user may take off the body fastening means 5. If the fire is not very serious and the life-saving device is not damaged, the user may afterwards go back to the room and rewind the metal strap 4 by using the rewinding disk 21 at one side of the middle seat 10. The rewinding disk 27 has a rotary shaft 26 at it center. The rotary shaft 26 is linked with a central hole of the main reel 20 and thus secured integrally with the main reel 20. In other words, it may turn with the main reel 20 or bring the main reel 20 to turn with it. The rewinding disk 27 is provided with a rotary handle 28. By turning the rotary handle 28, the main reel 20 will turn reversely, rewinding the metal strap 4 on the main reel 20.

The present invention may be conveniently used to help the user escape from the fire site. Several users may escape from the same room at the same time. The dropping speed may be adjusted to ensure safety.

Although the present invention has been illustrated and described with reference to the preferred embodiment thereof, it should be understood that it is in no way limited to the details of such embodiment but is capable of numerous modifications within the scope of the appended claims.

What is claimed is:

1. A personal portable life-saving device for helping a user to drop from a high building at a gradual and adjustable speed during fire accidents, said life-saving device comprising a housing that is a rectangular enclosed structure having an interior accommodating a reel set and a braking unit, a chest strap for tying about the user's chest being disposed at an upper end of the housing and a hips strap for tying about the user's hips being disposed at a lower end of the housing, said reel set comprising a main reel and two auxiliary rollers, said main reel having an annular strap groove, said auxiliary rollers being alternately arranged above said main rollers, said main rollers and said auxiliary each having a brake lining on both side of their respective sides; a metal strap wound round said main reel end received in said strap groove, said metal strap being passed round said auxiliary rollers to be pulled out from the upper end of said housing, said metal strap being provided with a rope and a snap ring at its upper end; and said braking unit comprising a first single braking plate at one side of said main reel and said auxiliary rollers within said housing, and a second single braking plate on the other side of said main reel and auxiliary rollers, a control disk being disposed externally of one of said braking plate, said control disk having a screw rod at its center for engaging a screw hole in said housing such that said control disk may be turned so that said screw rod thereof presses against or release said one of said braking plates.

2. The life-saving device as claimed in claim 1, wherein said control disk is provided with an extension rod that is foldable or extendable through 90 degrees for facilitating turning of said control disk.

3. The life-saving device as claimed in claim 1, wherein said control disk is located at an outer side of said main reel, and a press screw is disposed at one side of one of said auxiliary rollers for adjusting the pressing effect.

4. The life-saving device as claimed in claim 1, wherein a foldable handle is provided at one side of said housing opposite to said control disk on the other side thereof and is extendable through 90 degrees for gripping by the user.

5. The life-saving device as claimed in claim 1, wherein the upper end of said housing is provided with an upper cover for concealing said chest strap and said rope and snap ring of said metal strap, and the lower end of said housing is provided with a lower cover for concealing said hips strap.

6. The life-saving device as claimed in claim 1, wherein at least one guide roller is provided at the upper end of said housing such that said metal strap may be pulled out via said at least one guide roller.

7. The life-saving device as claimed in claim 1, wherein a rewinding disk is disposed at the other side of said main reel, said rewinding disk having a rotary shaft at its center, said rotary shaft being coupled with a central hole of said main reel so that they may turn synchronously, said metal strap being rewound by turning said rotary shaft to drive said main reel to turn reversely, said rotary shaft further having an extendable rotary handle for facilitating turning of said rewinding disk.

* * * * *